United States Patent [19]

Fitzgerald

[11] Patent Number: 4,508,351

[45] Date of Patent: Apr. 2, 1985

[54] GAME WITH INDIVIDUAL TWO PART BOARDS

[76] Inventor: Marilyn Fitzgerald, 117 Matawan Rd., Old Bridge, N.J. 08857

[21] Appl. No.: 503,543

[22] Filed: Jun. 13, 1983

[51] Int. Cl.[3] ..... A63F 3/00

[52] U.S. Cl. ..... 273/248

[58] Field of Search ..... 273/243, 248, 249, 287

[56] References Cited

U.S. PATENT DOCUMENTS

| | | | |
|---|---|---|---|
| 1,016,142 | 1/1912 | Hanley | 273/243 X |
| 3,401,936 | 9/1968 | Greenberg | 273/265 |
| 3,503,612 | 3/1970 | Singer | 273/272 |
| 3,785,654 | 1/1974 | Chambers | 273/249 |
| 3,796,432 | 3/1974 | Beakley | 273/243 |
| 4,118,035 | 10/1978 | Row | 273/243 |
| 4,136,879 | 1/1979 | Andrew et al. | 273/243 |
| 4,360,205 | 11/1982 | Rimbold | 273/256 |

FOREIGN PATENT DOCUMENTS

| | | | |
|---|---|---|---|
| 2502022 | 9/1982 | France | 273/280 |
| 2084027 | 4/1982 | United Kingdom | 273/243 |

*Primary Examiner*—Richard C. Pinkham
*Assistant Examiner*—Scott Brown

[57] ABSTRACT

A board game apparatus, played by one or more adult players, who, each play on their own individual, two-part playing board, while cooperatively, each player shares a supplementary game board that provides storage and additional playing areas for other supportive ingredients, such as markers, cards, playing pieces and spinners used in correlation with their own playing boards. One of a few ways to win this game is to complete a simulated karmic and reincarnational life's journey that is tied to hereditary and environmental factors chosen by a random method. First, each player must almost completely cover one section of their two-part playing board's playing area with markers, keyed to spinners from the supplementary game board. Having almost completely covered the one section, then the player proceeds, with a playing piece, through the second section, which is composed of paths, divided into spaces, some of which are obsticled and keyed to cards with information that may alter advancement.

5 Claims, 12 Drawing Figures

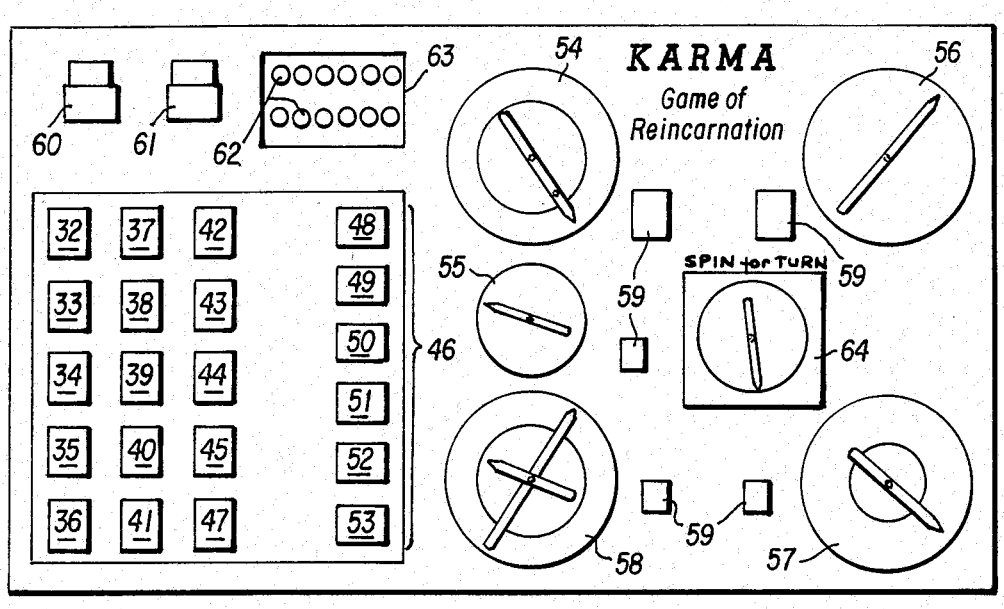
FIG. 2
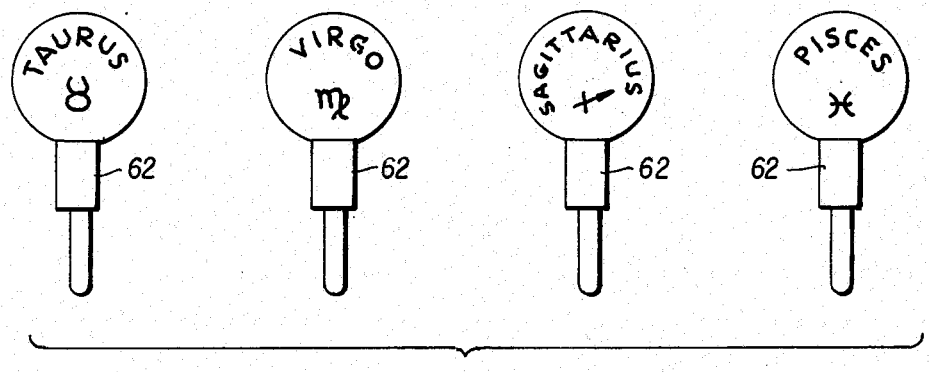
FIG. 3
| TIME PERIOD | SEXUAL PREFERENCE | OCCUPATION | RELIGION | MATE or BEST FRIEND |
|---|---|---|---|---|
| 1. 2100A.D. | 6. Bi-sexual | V. Driver of camels | 13. Sun worshiper | Skin Type E-5 Blotchy |
| 32 | 34 | 43 | 39 | 53 |
FIG. 4

GAME WITH INDIVIDUAL TWO PART BOARDS

This invention relates to board games and in particular to a novel conception, whereas all players are provided with their own individual two-part game playing boards, which are supported by a common supplementary game board. This supplementary game board furnishes the ingredients for a plurality of players to be advanced from a starting position to a stopping point or finish position, and in that process, an awareness is created of the metaphysical subjects of karma, reincarnation and astrology.

As is common knowledge, board games have attempted to simulate many faucets of society or aspects of sociological or scientific living, such as space, business, existence through financial loss or gain, etc. However, so far as it is presently known, there is no board game available which provides an awareness of the metaphysical subjects of karma and reincarnation, intertwined with more than one phase of life, beginning with specifics, such as time periods, childhoods, etc., and ending anywhere in life, with a definite cause of death. Furthermore, whereby a plurality of previous board games are aimed at an elementary or total family audience, this invention attempts to be an entertaining instrument for adults.

Accordingly, an object of my present invention is to broaden understanding of the consequential effects of karma and reincarnation, while taking a life's journey, in an adult type, humorous, entertaining fashion.

It is also an object of the present invention to provide more than one method of winning, making it possible for the game to be played by one individual competing against himself via time, or a plurality of players competing against each other, or against time also.

It is a further object of this present invention to provide a game, wherein the advance of each playing piece is subject to various karmic, reincarnational or social conditions, decisions and obsticles interposed and encountered, by chance, along a path of spaces. It is furthermore an object of said spaces that certain of which are influenced, humorously, by hereditary and environmental factors from birth through an end of life.

Some advantages of this invention are the convenience of each player having their own individual playing board, eliminating a conflict of being denied advancement because of previous playing pieces blocking a path; to provide the added convenience of precisely stated movements, solely, without the burden of accumulating objects or monies, etc., through addition or subtraction or other accounting methods.

Further objects and advantages of my invention will become apparent from a consideration of the drawing and ensuing decription thereof:

FIG. 2 is a top plan view of the supplementary game board that provides playing and storage areas for supportive ingredients to FIG. 1;

FIG. 3 is an elevated front view of four protuberant playing pieces used to represent individual players;

FIG. 4 is perspective views of five sets of small playing card markers used in association with the two-part playing board, FIG. 1;

Figure 1:
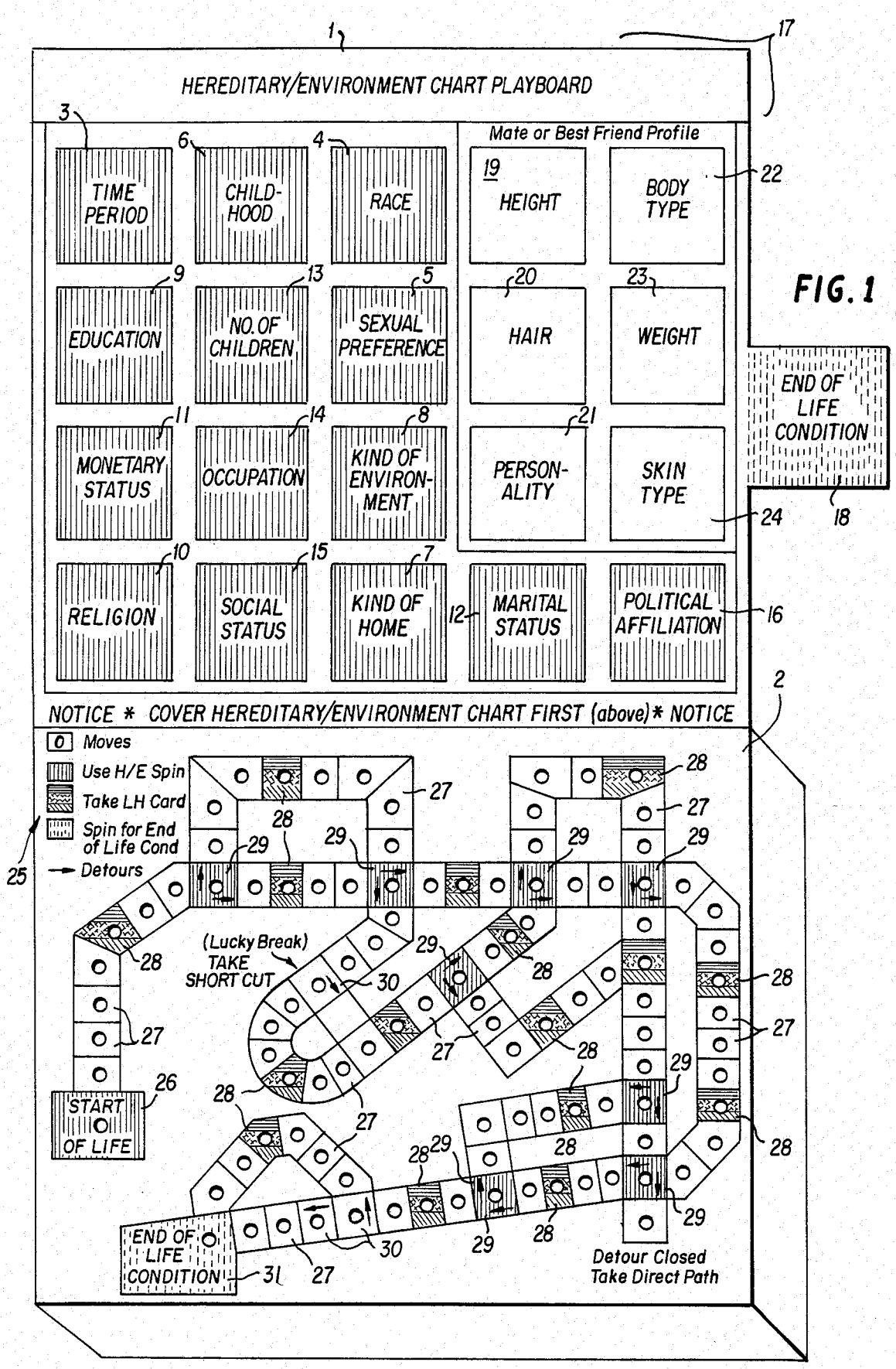
FIG. 1 is a perspective, top plan view of the playing surface of one of a plurality of portable, individual two-part playing boards.

Referring now to the drawings in detail, in specific to an individual two-part playing board FIG. 1, which comprises two, attached, distinctive parts or sections 1 and 2. A flat upper playing section, titled HEREDITARY/ENVIRONMENT CHART 1, makes up the first part, consisting of a chart of hereditary and environment categories, slightly depressed spaces 3 to 24. There are sixteen regular Hereditary-/Environment categorical spaces 3 to 16 (perimetered in red), space 17 (yellow) which includes spaces 19 to 24 as a subset, and space 18 (purple). Suggested hereditary-/environment categorical heading selections are as follows:

| SPACE REFERENCE NO. | HEADING LISTED ON CHART |
|---|---|
| 3 | Time period. |
| 4 | Race. |
| 5 | Sexual Preference. |
| 6 | Childhood. |
| 7 | Kind of Home. |
| 8 | Kind of Environment. |
| 9 | Education. |
| 10 | Religion. |
| 11 | Monetary Status. |
| 12 | Marital Status. |
| 13 | Number of Children. |
| 14 | Occupation. |
| 15 | Social Status. |
| 16 | Political Affiliation. |
| 17 | Mate or Best Friend Profile. |
| 18 | End of Life Condition. |
| SUBSET OF SPACE 17 | |
| 19 | Height, |
| 20 | Hair, |
| 21 | Personality, |
| 22 | Body Type, |
| 23 | Weight, and |
| 24 | Skin Type. |

The upper section 1 may preferably have other geometrically shaped spaces to represent spaces 3 to 24, and/or alternate geometric arrangements other than my preference of the square-type, depression spaces 3 to 24, combined within, to formulate a rectangular-like configuration, without affecting the principle of the game.

The slightly elevated lower playing section 2, which makes up the second part of FIG. 1, consists of a multiplicity of concaved, variably shaped playing spaces 26, 27, 28, 29, 30 and 31, sequently dividing and therefore creating a maze-like series of paths.

Lower playing section 2 conveniently provides a legend 25, describing specific board movements and/or other indicia. Corresponding with the said legend 25, certain spaces show instruction by my prefered reference to color, that is, 26 (pink), 28 (tri-colored with blue, orange, and green), 29 (red with two directional arrows), and 31 (purple) labeled End of Life Condition.

Blank spaces 27 have no color, as do some spaces 30. Obviously, color preference is an individual taste.

Upper section 1 conveniently folds forward over lower section 2 for easy storage, as does space 18, which folds onto the playing surface of upper section 1, FIG. 1, making FIG. 1 completely collaspsible. The two part playing boards are also small in size and light weight to be easily hand carried.

The purpose of the various playing spaces located on FIG. 1 will be described in greater detail hereinafter.

The supplementary game board FIG. 2, as previously indicated, provides storage and playing areas for supportive ingredients used in association with the playing of this invention. Representative of a stored ingredient are sets of small (yellow) playing card markers 32 to 53 of FIG. 2 and FIG. 4, used to cover the categorical headings of section 1 of FIG. 1, whereupon said markers are inserted into the depressed spaces 3 to 24. Said markers are divided into sixteen sets 32 to 47 and one subset 48 to 53 subdividing set 46. Said small playing card markers 32 to 53 of FIG. 2 and FIG. 4, may be conveniently constructed from a rigid-type paper or plastic. Said sets of markers 32 to 53 bear printed information pertinent to the previously indicated flat upper playing section of FIG. 1.

Additionally illustrative ingredients stored and used in the progressive playing of this game are five hereditary/environment spinners 54 to 58 and FIG. 8 to FIG. 12, i.e., an arrowed-shaped needle or needles, as this case may be, rotatably mounted over a circle, whereas said circle has been segmented into convenient multiples bearing various printed numerical, alphabetical, and/or other indicia pertinent and correlating to the previously mentioned sets of small (yellow) playing card markers 32 to 53 of FIG. 2 and FIG. 4. Using such a device as a spinner is an accepted, well known practice in game playing tradition, especially when multiples of indicia are needed spontaneously, whereby a die, another traditional game device used to determine a rate of advance, is not efficiently effective. Said spinners 54 to 58 and FIG. 8 to FIG. 12 may be of various coloring, sizes or designs of segmentation, circle within a circle, etc., just as the rotating arrow or arrows may also be of various lengths and design. Conveniently located next to each aforesaid spinner 54 to 58 and FIG. 8 to FIG. 12 are printed categorical heading list 59 informing a player what appropriate spinner is used for what category.

Figure 5:
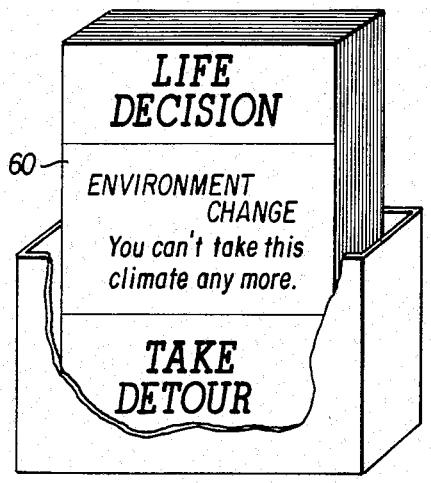
FIG. 5 is a perspective view of a set of cards providing instructional material in conjunction with the progress of this game.

Further representative ingredients stored on said supplementary game board FIG. 2, include a set of (red) Life Decision Cards 60 and FIG. 5, which consists of seventy-six variations of suggested indicia such as Taking Detours, Going Back, Going and Moving Ahead or Going Back to Start. Other information, besides the aforesaid indicia, is printed on the Life Decision Cards 60 and FIG. 5, based upon and relating to the previously indicated categories of the HEREDITARY/ENVIRONMENT CHART 1 of FIG. 1. Be it known that the (red) Life Decision Cards 60 and FIG. 5, colorfully correlate to spaces 29 located on the lower section 2 of FIG. 1, while correlating also to the aforementioned spinners 54 to 58 and FIG. 8 to FIG. 12.

Figure 6:
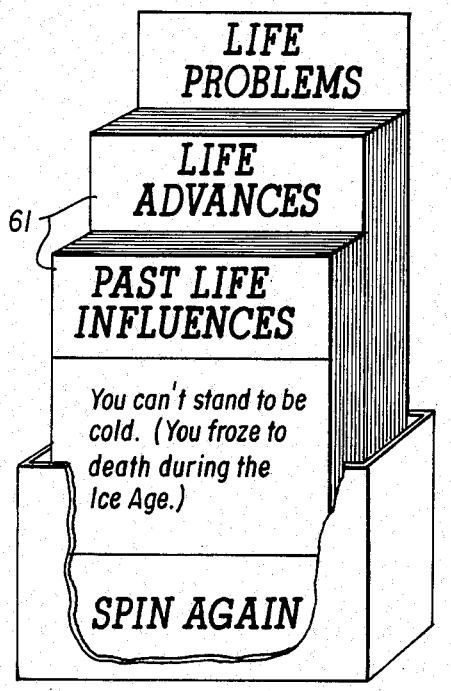
FIG. 6 is a perspective view of several cards from the combination of sets of cards providing instructional material in conjunction with the progress of this game.

Furthermore ingredients used in association with the playing of this invention and also stored on supplementary game board FIG. 2 include a set of Life Happening Cards 61 and FIG. 6, which consists of one-hundred fourteen total variations of information and/or instruction, being broken down into three color coordinated classifications; (blue) sixty-six Past Life Influence Cards, subdivided into a variety of indicia, such as Go Backs, Go Aheads and Spin Agains; (orange) thirty Life Problems Cards all stating Go Back and reasons thereof; and (green) twenty-eight Life Advances Cards all stating Go Ahead and reasons therof. Be it known that the set of Life Happening Cards 61 and FIG. 6 colorfully correlate to spaces 28, located on the lower section 2 of FIG. 1.

Indicia, information and/or instructions of a metaphysical, karmic, reincarnational or astrological nature could vary infinitely on all sets of cards 60, 61 or sets of cards markers 32 to 53.

Ideally positioned into a concave-type container 63 of FIG. 2, when not in use, are twelve, variably colored, individual, protuberant playing pieces 62 and FIG. 3, preferably referenced in the shapes of the well known Astrological Signs of the Zodiac. Said playing pieces 62 and FIG. 3 are designed specifically to plug into the concaved, playing spaces of lower playing section 2 of FIG. 1, whereby, said playing pieces are used to represent each player in the advancement of their moves.

Figure 7:
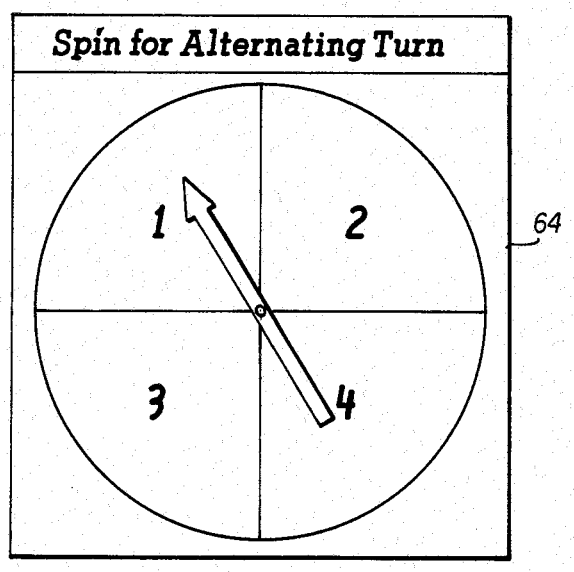
FIG. 7 is a plan, detailed view of the surface of a spinning device used to determine regular or alternating moves of players.

In addition to spinners 54 to 58 of FIG. 2, lying centrally located between said spinners 54 to 58 of FIG. 2 is an alternating turn spinner 64, FIG. 7. Preferred spinner 64, FIG. 7, although similiar in construction to the previously mentioned spinners 54 to 58, the alternating turn spinner 64, is simplied to the degree of numerically printed segments (four) and could easily be substituted for a die, if need be.

Before actually playing the game, certain preliminary steps are suggested to follow, such as shuffling of card sets 60, FIG. 5 and 61, FIG. 6, and also checking that sets of small (yellow) card markers 32 to 53, FIG. 4, are in their proper order, numerically or alphabetically, as the set may require. Another preliminary step is to decide the method a winner is determined from three choices as follows:

| Number of Method | Choice of Winning Method |
|---|---|
| 1 | First one advancing through End of Life Condition, space 31 is the winner. |
| 2 | Using a timing device, the player who advances the furthest distance at the end of a predetermined length of time is the winner. This method is advisable when only one player is playing against time. |
| 3 | Last one advancing through the End of Life Condition, space 31, is the winner. |

This game may be played by one player or by as many as are provided with playing pieces 62 and individual two-part playing boards FIG. 1, preferably, players may amount to twelve.

When all preliminary steps have been completed, start of play may begin, commencing with the covering of the upper playing section 1 of FIG. 1. Start of play on the lower playing section 2 of FIG. 1, can only began after each categorical space 3 to 17 of upper playing section 1 has been completed, except space 18. Space 18 is not covered until the end of the game.

Each player must set up his HEREDITARY/ENVIRONMENT CHART 1, beginning with the TIME PERIOD space 3. The player uses the appropiate, correlating spinner 59, 56 in this case, whereupon said spinner 56 tells him to choose one of the set of small card markers 32, which corresponds to the letter or number spun. If the small card marker of a particular set 32 to 53 has already been chosen, the player simply spins again. When said player has the proper corresponding small card marker of set 32, he places said marker 32 onto his HEREDITARY/ENVIRONMENT CHART 1, covering the TIME PERIOD space 3. By alternating, each player, in turn, will cover their TIME PERIOD space 3 in like manner.

Figure 8:
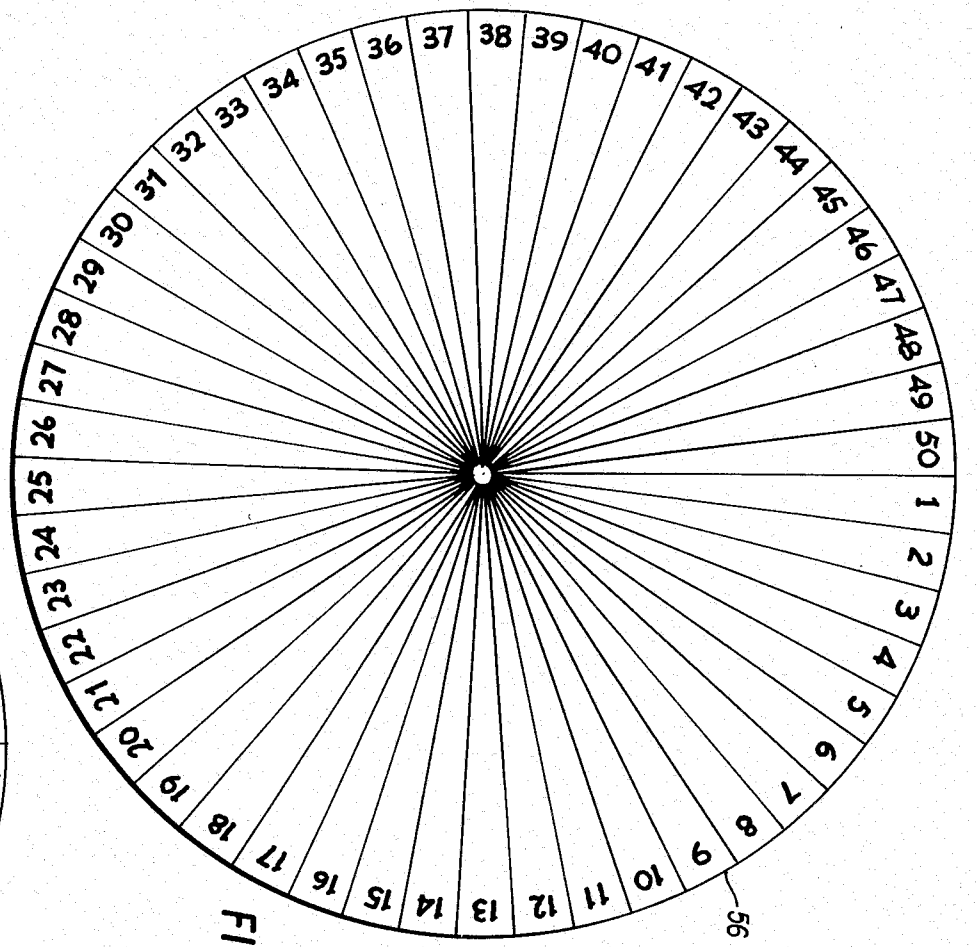
FIG. 8, FIG. 9, FIG. 10, FIG. 11, and FIG. 12 are plan, detailed views of the surface of spinning devices used to determine catergories in conjunction with the two-part playing board FIG. 1.

Always, by alternating turns, proceed to cover all categorical spaces 3 to 24, except space 18, using the appropriate 59, correlating spinner 56 to 58 and FIG. 8 to FIG. 12, to reference the proper corresponding small card marker of a set 32 to 53. The suggested order of coverage is as follows:

TIME PERIOD 3, correlating to spinner 56, FIG. 8, corresponding to small card marker set 32.

Figure 10:
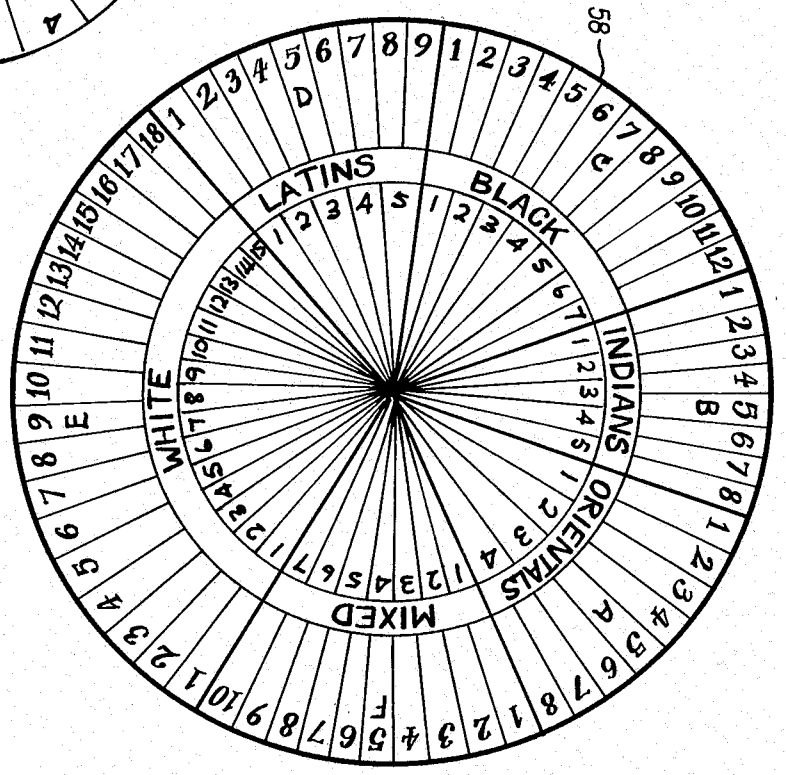

RACE 4, correlating to spinner 58, FIG. 10, corresponding to small card marker set 33.

SEXUAL PREFERENCE 5, correlating to spinner 56, FIG. 8, corresponding to small card marker set 34.

CHILDHOOD 6, correlating to spinner 56, FIG. 8, corresponding to small card marker set 35.

KIND OF HOME 7, correlating to spinner 56, FIG. 8, corresponding to small card marker set 36.

ENVIRONMENT 8, correlating to spinner 56, FIG. 8, corresponding to small cark marker set 37.

EDUCATION 9, correlating to spinner 56, FIG. 8, corresponding to small card marker set 38.

RELIGION 10, correlating to spinner 56, FIG. 8, corresponding to small card marker set 39.

MONETARY STATUS 11, correlating to spinner 56, FIG. 8, corresponding to small card marker set 40.

Figure 11:
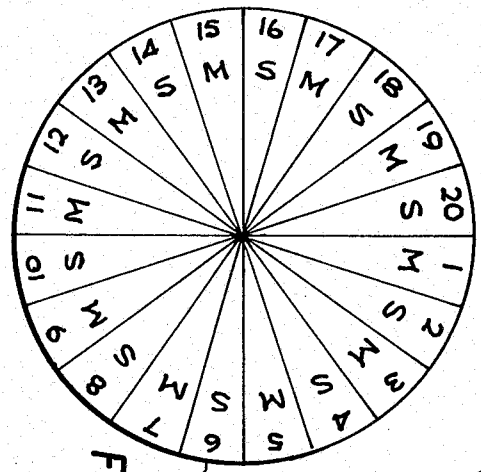

MARITAL STATUS 12, correlating to spinner 55, FIG. 11, corresponding to small card marker set 41.

NUMBER OF CHILDREN 13, correlating to spinner 56, FIG. 8, corresponding to small card marker set 42

Figure 12:
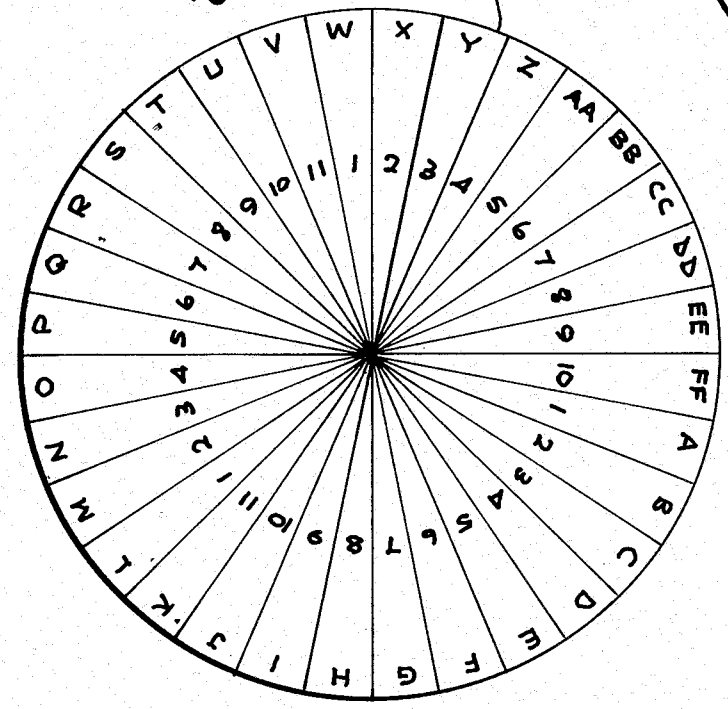

OCCUPATION 14, correlating to spinner 54, FIG. 12, corresponding to small card marker set 43.

Figure 9:
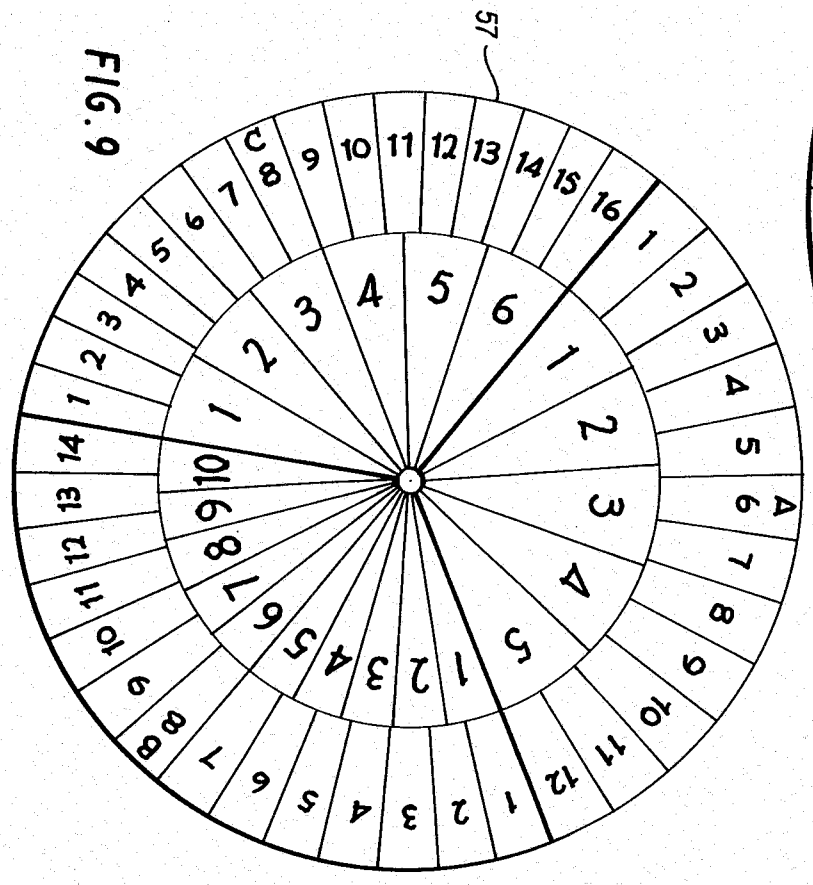

SOCIAL STATUS 15, correlating to spinner 57, FIG. 9, corresponding to small card marker set 44.

POLITICAL AFFILIATION 16, correlating to spinner 56, FIG. 8, corresponding to small card marker set 45.

MATE OR BEST FRIEND (PROFILE) 17, correlating to spinner 58, FIG. 10, corresponding to small card marker set 46, consisting of a subset of the following:

HEIGHT 19, correlating to spinner 58, FIG. 10, corresponding to small card marker set 48, HAIR 20, correlating to spinner 58, FIG. 10, corresponding to small carding marker set 49, PERSONALITY 21, correlating to spinner 58, FIG. 10, corresponding to small card marker set 50, BODY TYPE 22, correlating to spinner 58, FIG. 10, corresponding to small card marker set 51, WEIGHT 23, correlating to spinner 58, FIG. 10, corresponding to small card marker set 52, and SKIN TYPE 24, correlating to spinner 58, FIG. 10, corresponding to small card marker set 53.

If, when you use a spinner 54 to 58, you receive a number and/or letter that has no corresponding match in a set 32 to 53, therein, you are required to spin again until you have made a match.

As each player completes the coverage of his HEREDITARY/ENVIRONMENT CHART 1, except, as previously noted, space 18, that player is ready to began advancing on the lower, concaved, mazed-like paths of section 2 of FIG. 1.

Each player selects, either at this time, or previously, an astrological sign playing piece 62 and FIG. 3 and thereby places said playing piece 62 into his starting space 26 position. As has been previously indicated, playing pieces FIG. 3 have a protuberant base that conveniently fits or plugs into the concaved areas of lower section 2.

While still alternating turns, a player spins the alternating turn spinner 64 to determine the number of advances on lower section 2. The player will then move his playing piece 62 the required amount of stated advancements. The space which the player stops on, may indicate his next move, immediately, if the space 28, 29, or 30 is an indicator of a condition or obsticle. If your next move has not been indicated immediately, because you have landed on a blank space 27, you use the alternating turn spinner 64, when your turn comes around again. Movements continue in like manner. Having almost reached the End of Life Condition space 31, requires an exact amount of advancements (one, two, three or four), as generated by the alternating turn spinner 64, whereby the journey is completed. Having landed on said space 31, the player must now use the appropriate correlating categorical spinner 57, FIG. 9 to determine the proper corresponding small card marker from set 47, chosen to cover correlating space 18, whereupon is stated the cause or condition at the end of life. If the game is being played on a timed basis and the length of time previously chosen has elasped, each player will spin, in like manner as has been previously indicated, for the cause or condition of the end of life, even if they have not reached space 31.

As previously indicated, spaces 28, 29 and 30 symbolize a condition or obsticle, therefore, if a player lands on a Life Decision, (red arrowed) space 29, said player is required to take a Life Decision Card 60, FIG. 5 and thereupon, read the instructions. If necessary, spin appropriate hereditary/environment spinner 54 to 58 and FIG. 8 to FIG. 12, stated on chosen card 60. Put new small card marker from set 32 to 53, on upper section 1 in place of the small card marker now occupying the space 3 to 24. Replace old small card marker into its proper storage area 32 to 53 of FIG. 2. Now advance or take detour, according to instructions. If an END OF LIFE card should be chosen from the set of Life Decision Cards 60, do not use spinner 54 to 58, but simply follow instructions on said card. If a player lands on a Life Happening, [tri-colored (blue, orange or green)] space 28, he must choose a card from the set of Life Happening Cards 61, FIG. 6. Follow the instructions on said card to determine his next movement. Landing on an arrowed space 30, requires a player to follow the direction of the arrow when his turn commences again.

Having thus described this invention, it is to be understood that the various embodiments drawn and portrayed therein, are not to be construed as limitations on the scope of this invention, but rather as an examplification of one preferred embodiment thereof. Numerous variations, modifications and changes could result, without departing from the spirit and purpose of the invention. For example, the arrangements of pathways, stored areas, playing areas or playing spaces may be altered in a variety of geometric considerations. Therefore, the scope of this invention should be determined by the appended claims hereinafter.

What is claimed is:

1. A reincarnational, karmic board game apparatus comprising:

a plurality of individual, two-part playing boards consisting of:

a first playing section containing separate categorical playing spaces within, whereby said spaces have to be covered with playing pieces;

a second playing section having paths marked thereon, characteristically divided into spaces that have a central concavity, whereby, certain of said spaces provide a starting area, an ending area, blank areas, single arrowed detour areas, colored multi-arrowed decision making areas and further colored obsticle areas, whereupon all of the previously mentioned said spaces unite to form a mazed means to take a simulated reincarnational, karmic life journey;

a supplementary game board providing playing and storage areas for supportive ingredients used in cooperation with the said individual, two-part playing boards, whereby, said ingredients consist of:

sets of unique, playing markers and their storage areas thereof, whereupon, said markers are used to cover separate categorical spaces of said first playing section of said individual, two-part playing boards;

a plurality of categorical spinner playing devices, providing the referenced indicia and instructions therein, for said markers and their placement thereinafter;

sets of cards and their storage areas thereof, whereby said card sets, being correlated with certain said spaces of said second playing section, are printed with indicia, information and directions, whereas, said indicia, information or directions could alter movements of a playing position;

a plurality of protuberant playing pieces and their storage areas therein, having the shapes of the astrology signs of zodiac, whereby said playing pieces are used as a means to advance along said paths of said concaved spaces;

a spinner device printed with numerals used for the purpose of advancing regular movements of said playing pieces along said paths.

2. A board game apparatus, according to claim 1, wherein, said individual, two-part playing boards are of small enough size and light in weight, to be easily carried about by hand to various playing sites, rendering said boards portable, whereby said portability of said boards is further achieved by means of various folds, providing collapsibility, for easy storage.

3. A board game apparatus, according to claim 1, wherein, said first section playing spaces are depressed, providing a means for said markers to remain in position, whereby, said depression further provides a means for said markers to remain in position by being correlated to the size and shape of said markers.

4. A board game apparatus, according to claim 1, wherein, said sets of markers contain specific hereditary and environmental information, whereby said information correlates to said plurality of categorical spinner playing devices, thereby providing the random choice of said markers to be placed on said first section.

5. A board game apparatus, according to claim 4, wherein, said plurality of categorical spinner playing devices have printed within their multi-segmented areas, the key or keys to the location of a specific marker from the number of said sets of markers.

* * * * *